US005791482A

United States Patent [19]

Murphy et al.

[11] Patent Number: 5,791,482

[45] Date of Patent: Aug. 11, 1998

[54] PACKAGED ASSORTMENT OF ARTIFICIAL FINGERNAILS

[75] Inventors: Martha J. Murphy; Antonio P. Piña; Christina Kelly, all of El Paso, Tex.

[73] Assignee: Helen of Troy, L.P., El Paso, Tex.

[21] Appl. No.: 893,557

[22] Filed: Jul. 11, 1997

[51] Int. Cl.[6] ..... B65D 71/00; A45D 29/00

[52] U.S. Cl. ..... 206/581; 132/73; 206/232; 206/470; 206/734

[58] Field of Search ..... 206/581, 232, 206/730, 733, 734, 470; 132/73, 75

[56] References Cited

U.S. PATENT DOCUMENTS

| | | | |
|---|---|---|---|
| 1,282,485 | 10/1918 | Sterling | 132/73 X |
| 2,563,689 | 8/1951 | Muhlhauser | 206/815 X |
| 2,633,139 | 3/1953 | Pettey | 132/73 X |
| 3,485,344 | 12/1969 | Aylott | 206/784 |
| 3,982,551 | 9/1976 | Bartolucci | 132/73 |
| 4,106,614 | 8/1978 | Aylott | 206/581 X |
| 4,140,139 | 2/1979 | Aylott | 132/73 |
| 4,824,702 | 4/1989 | Straub | 132/73 X |
| 4,903,840 | 2/1990 | So | 206/581 |

*Primary Examiner*—Bryon P. Gehman

*Attorney, Agent, or Firm*—John E. Toupal; Harold G. Jarcho

[57] ABSTRACT

A packaged assortment of artificial fingernails including a package defining a storage chamber, a display compartment with a transparent wall portion, and a cavity having an inner end disposed adjacent to said display compartment, the cavity having a transparent wall section and being shaped and arranged to receive a finger end visible therethrough. Also included in the package are a plurality of artificial fingernails of various sizes retained within the storage chamber and an artificial fingernail of given size retained in the display compartment and having a fingernail end adjacent to the inner end of the cavity, the fingernail of given size having a fingernail surface visible through the transparent wall portion. The display compartment, cavity and artificial fingernail of given size facilitate selection of a package retaining fingernails of sizes appropriate for a particular user.

22 Claims, 3 Drawing Sheets

PACKAGED ASSORTMENT OF ARTIFICIAL FINGERNAILS

BACKGROUND OF THE INVENTION

This invention relates generally to packaged assortments of artificial fingernails and, more particularly, to packaged fingernail assortments from which a purchaser can easily select an assortment having fingernails with sizes appropriate for the purchaser's fingers.

Artificial fingernails are used widely to adorn and beautify woman's fingers. Generally, the artificial nails are secured to upper surfaces of the woman's own fingernails with a suitable adhesive. After attachment, the artificial nails can be trimmed and polished to produce a desired effect. The use of artificial fingernails can reduce significantly the time spent on fingernail care in addition to alleviating particular fingernail problems such as breakage and imperfections.

The convenient selection of appropriately sized artificial fingernails, however, has presented difficulties. Because of the wide variety of finger sizes, the selection of suitable artificial nails can be tedious and time consuming. In addition, efficient display, packaging and inventorying of artificial nails have posed perplexing problems. Prior attempts to diminish these problems have included fingernail packaging techniques disclosed in U.S. Pat. No. 4,106,614. Described and shown in that patent are packages retaining visible, interconnected artificial nails of various sizes and a package retaining a single visible artificial nail of a given size. However, none of the disclosed packages provides a satisfactory solution to the problems associated with selection and presentation of artificial fingernails.

The object of this invention, therefore, is to provide artificial fingernail packaging which simplifies selection of appropriately sized fingernails.

SUMMARY OF THE INVENTION

The invention is a packaged assortment of artificial fingernails including a package defining a storage chamber, a display compartment with a transparent wall portion, and a cavity having an inner end disposed adjacent to the display compartment, the cavity having a transparent wall section and being shaped and arranged to receive a finger end visible therethrough. Also included in the package are a plurality of artificial fingernails of various sizes retained within the storage chamber and an artificial fingernail of given size retained in the display compartment and having a fingernail end adjacent to the inner end of the cavity, the fingernail of given size having a fingernail surface visible through the transparent wall portion. The display compartment, cavity and artificial fingernail of given size facilitate selection of a package retaining fingernails of sizes appropriate for a particular user.

According to one feature of the invention, the cavity has an open outer end disposed at an outer perimeter of the package. This feature simplifies insertion of a finger into the cavity.

According to another feature of the invention, the cavity is tapered with the inner end being smaller than the outer end. The tapered cavity assists in guiding a finger into position adjacent to the display compartment.

According to still another feature of the invention, the tapered cavity has an open bottom and a semiconically shaped top comprising the transparent wall section. This feature simplifies construction of the package.

According to yet other features of the invention, the package includes juxtaposed upper and lower walls defining therebetween the storage chamber, the display compartment and the tapered cavity; at least one of the walls is deformed to form the storage chamber; both of the walls have recessed wall portions projecting in the same direction, and being closely spaced apart and shaped and arranged to provide the display compartment with a geometry which securely retains the fingernail of given size; and the upper and lower walls have engaged, unidirectionally projecting portions which form the transparent wall section of the semiconically shaped top. These features further simplify construction of the package.

According to a further feature of the invention, the upper and lower walls have edges formed by engaging neck and shoulder portions which terminate at the open outer end of the tapered cavity. The engaging neck and shoulder portions facilitate assembly of the package and their termination at the outer end of the tapered cavity simplifies construction of the semiconically shaped top thereof.

According to additional features of the invention, the upper and lower walls are transparent, the package includes a printed information sheet disposed between the upper and lower walls and the information sheet defines a slot conforming to and aligned with the display compartment and the tapered cavity. The information sheet functions to conveniently provide instructions for use of the package and the slot in the sheet insures desired visibility into the display compartment and tapered cavity.

According to yet another feature of the invention, the plurality of artificial fingernails include fingernails of four to seven predetermined sizes each smaller than the fingernail of given size. The provision of four to seven fingernail sizes associated with the display fingernail of given size satisfies the fingernail sizes required for all fingers of a particular user.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
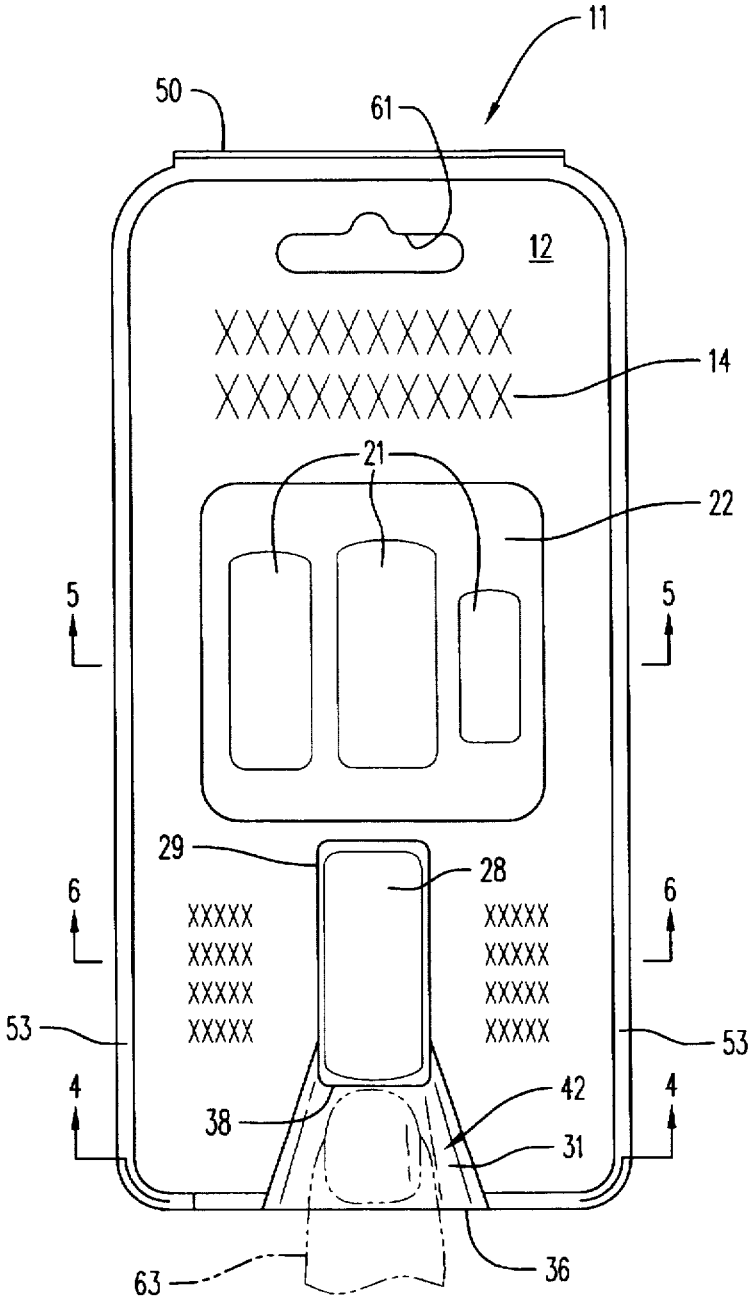
FIG. 1 is a plan view of a packaged assortment of artificial fingernails according to the invention.
Figure 3:
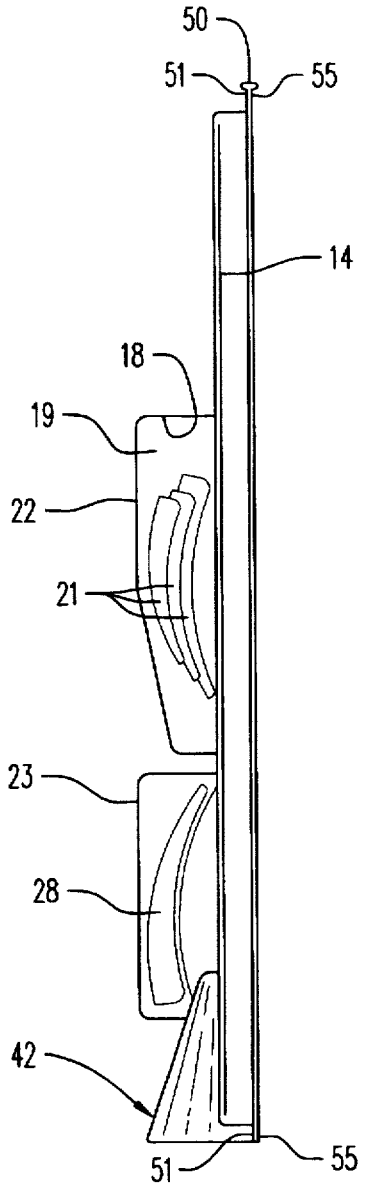
FIG. 3 is a side elevational view of the packaged assortment shown in FIGS. 1 and 2.

A fingernail display package 11 is formed by upper and lower transparent walls 12, 13. Retained between the upper and lower walls 12, 13 is a printed information sheet 14 with an upper printed surface visible through the transparent upper wall 12. The upper wall 12 includes a molded, deformed portion 18 that defines a storage chamber 19. Retained within the storage chamber 19 are a plurality of artificial fingernails 21 of various size. The artificial fingernails 21 are visible through a wall portion 22 of the transparent wall 12.

Figure 6:
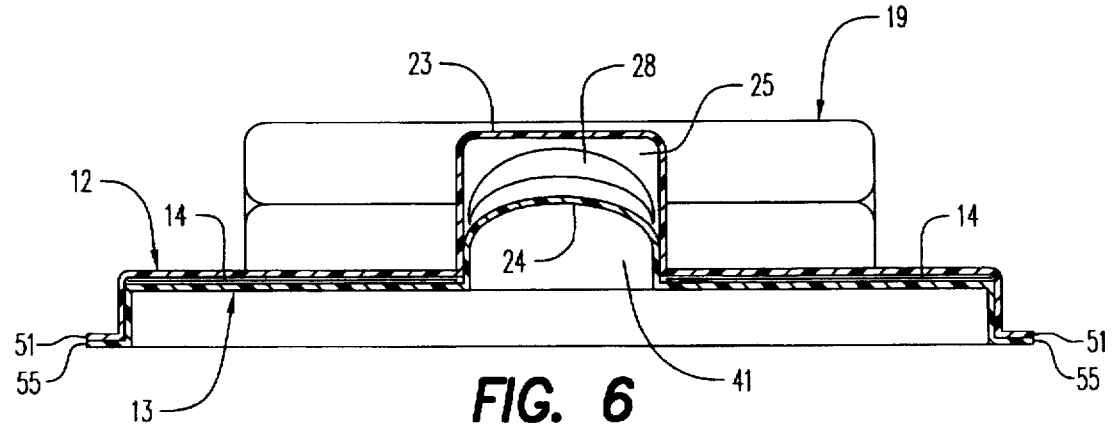
FIG. 6 is a cross-sectional view taken along lines 6—6 of FIG. 1.

As shown in FIG. 6, the upper wall 12 also includes an upwardly projecting recessed wall portion 23 which is aligned with an upwardly projecting, recessed wall portion 24 of the lower wall 13. The recessed wall portions 23, 24 are closely spaced apart and form a display compartment 25 therefor shaped and arranged to securely retain an artificial fingernail 28 which provides a fingernail shaped display of a predetermined given size. A display portion 29 of the transparent upper wall 12 renders the artificial fingernail 28 visible in the compartment 25.

Figure 4:
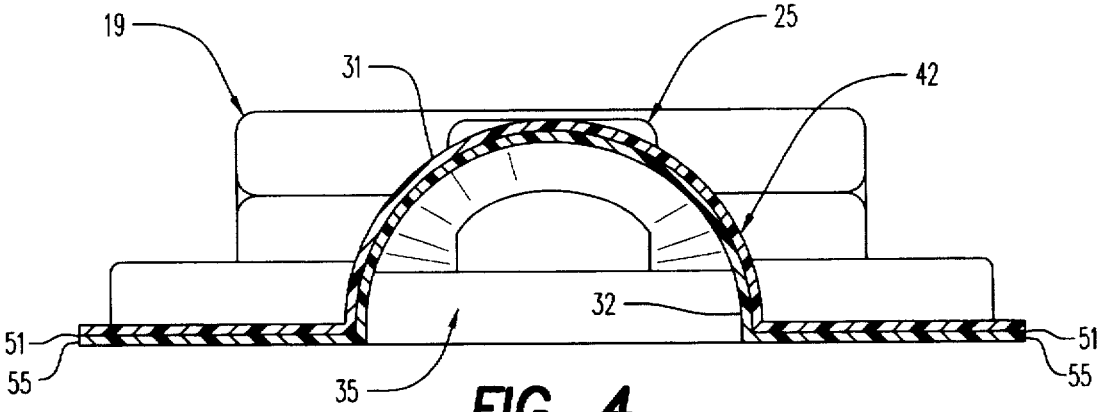
FIG. 4 is a partial cross-sectional view taken along lines 4—4 of FIG. 1.

The upper and lower walls 12, 13 also include, respectively, semiconically shaped, upwardly projecting and engaged transparent wall sections 31, 32. Formed by the wall sections 31, 32 is a tapered cavity 35. An open outer end 36 of the tapered cavity 35 is located at an outer perimeter of the package 11 and a smaller inner end 38 of the tapered cavity 35 is located directly adjacent to the display compartment 25. As shown in FIG. 4, the tapered cavity 35 has an open bottom 41 and a semiconically shaped, concave top 42 formed by the engaged transparent wall sections 31, 32 of, respectively, the upper and lower walls 12, 13. A slot 45 extending from an outer edge of the information sheet 14 conforms with and is aligned with the tapered cavity 35 and the display compartment 25.

Figure 2:
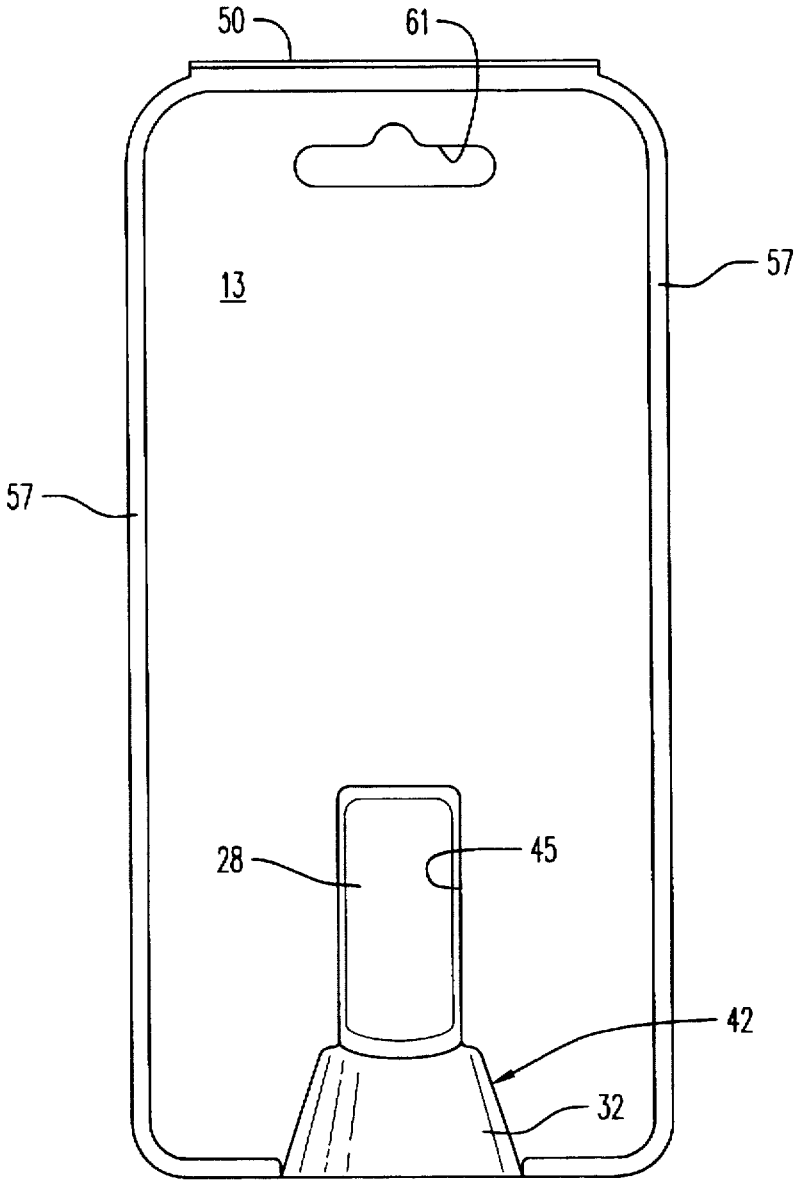
FIG. 2 is a bottom view of the packaged assortment shown in FIG. 1.
Figure 5:
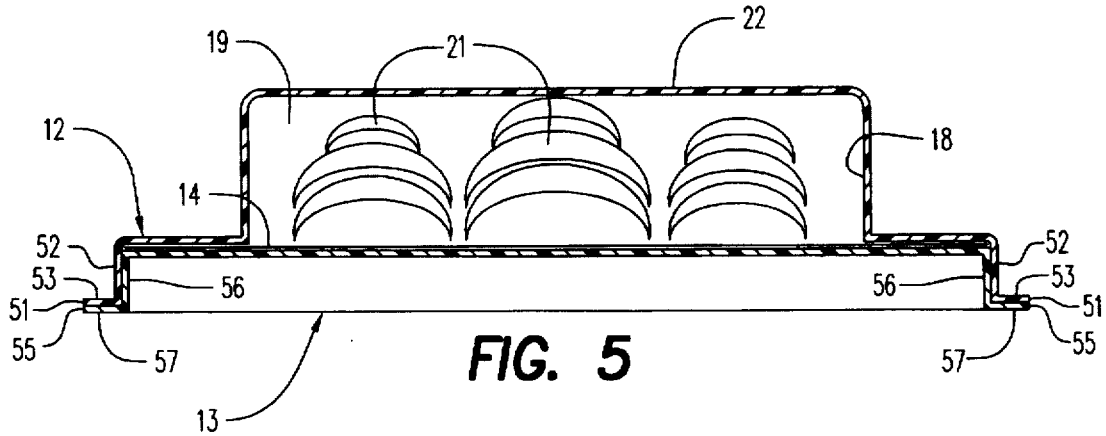
FIG. 5 is a cross-sectional view taken along lines 5—5 of FIG. 1.

As shown in FIGS. 5 and 6, an outer edge 51 of the upper wall 12 is formed by a downwardly extending neck portion 52 and an outwardly projecting transverse shoulder portion 53. Similarly, an outer edge 55 of the lower wall 13 is formed by a downwardly extending neck portion 56 and an outwardly projecting transverse shoulder portion 57. The neck and shoulder portions 52, 53 and 56, 57 all terminate at the open outer end 36 of the tapered cavity 35 as shown in FIGS. 2 and 4. At an opposite end of the package 11, the edges 51, 52 are joined to form a hinge portion 50.

During assembly of the package 11, the artificial fingernail 28 of a predetermined given size is positioned within the display compartment 25 between the recessed wall portions 23, 24 of, respectively, the upper wall 12 and the lower wall 13. Preferably, the fingernail 28 has a size suitable for use on the thumb of a person having fingers of a size selected from a range of known sizes extending from small to large. The plurality of artificial fingernails 21 also are positioned within the storage chamber 19 defined between the upper and lower walls 12, 13. Preferably, the plurality of fingernails 21 include fingernails of between four and seven sizes, each smaller than the given size of the fingernail 28 and suitable for use on smaller fingers typically compatible with the thumb size associated with the fingernail 28. In addition, at least one other fingernail having the given size of the display fingernail 28 is inserted into either the display compartment 25 or the storage chamber 19. After insertion of the artificial fingernails 21 and 28, the shoulder and neck portions 52, 53 and 56, 57 are pressed together to provide a frictional engagement that removably secures the upper wall 12 to the lower wall 13.

To allow suitable artificial fingernail selection by persons of various finger sizes, there are provided plural sets of packages 11 with each set having a different sized display fingernail 28 appropriate for use on a thumb of predetermined size and a plurality of fingernails 21 having smaller sizes associated with fingers typically compatible with the predetermined thumb size. The sets of packages 11 can be displayed on hooks (not shown) projecting through openings 61 formed by aligned apertures in the upper and lower walls 12, 13 and the information sheet 14.

A purchaser examines the displayed sets of packages 11 and selects therefrom a package having a display fingernail visually compatible with the purchaser's thumb size. To confirm the suitability of the selected package, the purchaser inserts a thumb 63 (FIG. 1) into the tapered cavity 35 into a position juxtaposed to the artificial fingernail 28 visible in the display compartment 25. With the inserted thumb 63 also visible through the transparent wall sections 31, 32 of the tapered cavity 35, the purchaser can easily determine size compatibility between the purchaser's thumbnail and the displayed artificial thumbnail 28. Having selected a package with a befitting displayed thumbnail 28, the selected package's other fingernails 21 typically will include sizes suitable for the purchaser's smaller fingers.

Obviously, many modifications and variations of the present invention are possible in light of the above teachings. It is to be understood, therefore, that the invention can be practiced otherwise than as specifically described.

What is claimed is:

1. A packaged assortment of artificial fingernails comprising:

a package defining a storage chamber, a fingernail shaped display of given size, and a cavity disposed adjacent to said display, said cavity having a transparent wall section and being shaped and arranged to receive a finger end in juxtaposition to said display and visible through said transparent wall section; and a plurality of artificial fingernails of various sizes retained within said storage chamber.

2. A packaged assortment according to claim 1 wherein said package further defines a display compartment with a transparent wall portion, and said fingernail shaped display comprises an artificial fingernail of said given size and visible through said transparent wall portion.

3. A packaged assortment according to claim 2 wherein said cavity has an open outer end disposed at an outer perimeter of said package.

4. A packaged assortment according to claim 3 wherein said transparent wall section is concave.

5. A packaged assortment according to claim 4 wherein said transparent wall section is tapered with said open outer end being of one size and said inner end being smaller than said one size.

6. A packaged assortment according to claim 4 wherein said cavity has an open bottom and a top comprising said transparent wall section.

7. A packaged assortment according to claim 3 wherein said package comprises juxtaposed upper and lower walls defining therebetween said storage chamber, said display compartment and said cavity.

8. A packaged assortment according to claim 7 wherein at least one of said walls is deformed to form said storage chamber; and each of said walls has a recessed wall portion, said recessed wall portions projecting in the same direction, and shaped and arranged to form said display compartment with a geometry which securely retains the position of said fingernail of given size.

9. A packaged assortment according to claim 8 wherein said upper and lower walls have engaged, unidirectionally projecting portions which form said transparent wall section of said cavity.

10. A packaged assortment according to claim 7 wherein said upper and lower walls have edges formed by engaging neck and shoulder portions which terminate at said open outer end of said cavity.

11. A packaged assortment according to claim 8 wherein at least one of said walls is deformed to form said storage chamber; and each of said walls has a recessed wall portion, said recessed wall portions projecting in the same direction, and shaped and arranged to form said display, compartment with a geometry which securely retains the position of said fingernail of given size.

12. A packaged assortment according to claim 11 wherein said upper and lower walls have engaged, unidirectionally projecting portions which form said transparent wall section of said cavity.

13. A packaged assortment according to claim 12 wherein said upper and lower walls are transparent, and including a printed information sheet disposed between said upper and lower walls.

14. A packaged assortment according to claim 13 wherein said information sheet defines a slot conforming to and aligned with said display compartment and said tapered cavity, and said edges form a hinge portion opposite to said cavity.

15. A packaged assortment according to claim 12 wherein said plurality of artificial fingernails include fingernails of at least four predetermined sizes each smaller than said fingernail of given size.

16. A packaged assortment according to claim 15 wherein said plurality of artificial fingernails include fingernails of seven predetermined sizes each smaller than said fingernail of given size.

17. A packaged assortment of artificial fingernails comprising:

a package having juxtaposed upper and lower walls defining therebetween a storage chamber formed by storage portions of said upper and lower walls and a display compartment formed by display portions of said upper and lower walls, said display portion of said upper wall being transparent;

an artificial fingernail of given size retained within said display compartment and visible through said transparent display portion of said upper wall; and a plurality of artificial fingernails retained within said storage chamber and including fingernails of at least four predetermined sizes each smaller than said fingernail of said given size.

18. A packaged assortment according to claim 17 wherein said plurality of artificial fingernails include fingernails of seven predetermined sizes each smaller than said fingernail of given size.

19. A packaged assortment according to claim 16 wherein said upper and lower walls are transparent, and including a printed information sheet disposed between said upper and lower walls.

20. A packaged assortment according to claim 17 wherein said upper and lower walls are transparent, and including a printed information sheet disposed between said upper and lower walls.

21. A packaged assortment of artificial fingernails comprising:

a package defining a storage chamber, and a display compartment having a transparent wall portion;

an artificial fingernail of given size retained within said display compartment and visible through said transparent wall portion; and a plurality of artificial fingernails retained within said storage chamber and including fingernails of at least four predetermined sizes each smaller than said fingernail of given size.

22. A packaged assortment according to claim 21 wherein said plurality of artificial fingernails include fingernails of seven predetermined sizes each smaller than said fingernail of given size.

* * * * *

Disclaimer 5,791,482 - Martha J. Murphy; Antonio P. Piña; Christina Kelly, all of El Paso, Texas. PACKAGED ASSORTMENT OF ARTIFICIAL FINGERNAILS. Patent dated August 11, 1998. Disclaimer filed August 9, 1999, by the assignee, Revlon Consumer Products Corporation.

Hereby enters this disclaimer to claims 1-22 of said patent.

*(Official Gazette,* September 21, 1999)